US008863722B2

(12) United States Patent
Osugi et al.

(10) Patent No.: US 8,863,722 B2
(45) Date of Patent: Oct. 21, 2014

(54) CYLINDER BLOCK AND METHOD OF MACHINING SAME

(75) Inventors: Akihiro Osugi, Tochigi (JP); Masao Onishi, Tochigi (JP); Kazushi Sogawa, Tochigi (JP); Nobuyuki Akaishi, Wako (JP); Masayuki Takahashi, Wako (JP); Minoru Iga, Tochigi (JP); Nozomu Tanaka, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 3 days.

(21) Appl. No.: 13/700,327

(22) PCT Filed: May 18, 2011

(86) PCT No.: PCT/JP2011/061424

§ 371 (c)(1),
(2), (4) Date: Feb. 12, 2013

(87) PCT Pub. No.: WO2011/152216

PCT Pub. Date: Dec. 8, 2011

(65) Prior Publication Data

US 2013/0139781 A1 Jun. 6, 2013

(30) Foreign Application Priority Data

Jun. 1, 2010 (JP) ..... 2010-125930
Jun. 1, 2010 (JP) ..... 2010-125934

(51) Int. Cl.
*F02F 1/00* (2006.01)
*F02F 7/00* (2006.01)
*B24B 33/02* (2006.01)

(52) U.S. Cl.
CPC ..... *F02F 1/002* (2013.01); *B24B 33/02* (2013.01); *F02F 2007/0041* (2013.01); *F02F 7/00* (2013.01)
USPC ..... 123/195 R; 29/888.06; 451/51

(58) Field of Classification Search
USPC ..... 123/195 R, 193.2; 29/888.01, 888.06; 700/159; 451/51
See application file for complete search history.

(56) References Cited

U.S. PATENT DOCUMENTS 6,973,367 B2 * 12/2005 Klink et al. ..... 700/159

FOREIGN PATENT DOCUMENTS

DE 1576404 3/1970
GB 570738 7/1945

(Continued)

OTHER PUBLICATIONS

Machine translation of Detailed Description, JP2000291487A, Owada et al., pp. 1-11.*

(Continued)

*Primary Examiner* — Noah Kamen
*Assistant Examiner* — Grant Moubry
(74) *Attorney, Agent, or Firm* — Rankin, Hill & Clark LLP

(57) ABSTRACT

A machined shape of a bore is based on the deformation amount of a data-acquisition bore after fastening of cylinder head. A cross section of an approximate shape is set to be an approximately-true circle shape, and a diameter of the approximately-true circle shape is changed along a central axial direction in accordance with the deformation amount of the data-acquisition bore, to determine the approximate shape. The approximate shape has a cross section having the approximately-true circle shape and has a simple shape which is symmetrical about the central axis. Since the machined shape of the bore is the shape obtained by reversing a phase of a recess and a projection of the approximate shape about a predetermined cylindrical shape, the machined shape has a cross section having the approximately-true circle shape and has a simple shape which is symmetrical about the central axis.

2 Claims, 6 Drawing Sheets

(56) References Cited

FOREIGN PATENT DOCUMENTS

| | | |
|---|---|---|
| JP | 08-252764 | 10/1996 |
| JP | 2000-291487 | 10/2000 |
| JP | 2009-078320 | 4/2009 |

OTHER PUBLICATIONS

German Office Action received by Applicant on Apr. 10, 2014, 4 pages. English translation included.
German Office Action dated Apr. 10, 2014, 4 pages.

* cited by examiner

CYLINDER BLOCK AND METHOD OF MACHINING SAME

TECHNICAL FIELD

The present invention relates to a cylinder block having a cylinder bore and relates to a machining method for the same. In particular, the present invention relates to an improvement in a superior technique for the cylindricity of a cylinder bore after fastening of a cylinder head.

BACKGROUND ART

In a cylinder block of an internal-combustion engine, a cylinder bore (hereinafter simply referred to as a "bore"), which slides relative to a piston via an oil film, is formed, and a cylinder head is fastened to the cylinder block. FIG. 1 is a plane view which shows a schematic structure of a specific example of a cylinder block 210 used in a four-cylinder engine. FIG. 2 is a side cross sectional view which shows a condition in which a cylinder head 220 is fastened to the cylinder block 210. In FIG. 1, only bores 211 and bolt holes 212 are shown. In the application, a cross section perpendicular to an axial direction is defined as a "cross section", and a cross section parallel to an axial direction is defined as a "side cross section".

For example, the cylinder block 210 is made of an Al (aluminum) material, four bores 211 and ten bolt holes 212 are formed at an upper surface of the cylinder block 210. Bolts 230 are fastened to the ten bolt holes 212 of the cylinder block 210 via bolt holes 222 of the cylinder head 220, so that the cylinder head 220 is fixed on the upper surface of the cylinder block 210. A gasket 240 is provided between the cylinder block 210 and the cylinder head 220.

A water jacket 213 is formed between the bore 211 and the bolt hole 212. For example, each bore 211 is formed by a sleeve 214 of a cast iron, a crosshatch is formed by honing on an inner surface of each sleeve 214, and the inner surface thereof is used as a sliding surface. Each bore 211 may be formed by an inner surface of a hole portion formed at the cylinder block 210 instead of providing the sleeve 214.

An inner surface 211A of the bore 211 is subjected to boring and honing, so that as shown in FIG. 3A, the inner surface 211A is formed to have a cylindrical shape of which a side cross section has a straight shape and of which a cross section has an approximately-true circle shape. However, when the cylinder head 220 is fastened by bolts to the upper surface of the cylinder block 210, as shown in FIG. 3B, the inner surface 211A of the bore 211 is deformed so as to be an inner surface 211B. Specifically, an inner diameter of an upper end portion 213 of the inner surface 211A of the bore 211 is larger, and an inner diameter of an intermediate portion 214 of the inner surface 211A of the bore 211 is smaller, so that constriction occurs at the inner surface 211A of the bore 211. Due to this, when a piston slides along the bore 211, friction at the intermediate portion 214 is greater.

In order to improve the cylindricity of the bore 211 after fastening of the cylinder head 220, it has been proposed that the cross section of the bore 211 be machined so as to have a shape which is not a true circle shape in consideration of deformation of the bore 211 which will occur in the fastening of the cylinder head 220 (see Patent Document 1, for example). In the technique of Patent Document 1, the cross section of the bore is postformed so as not to have a true circular shape before the cylinder head is fastened to the cylinder block. In this case, the machined shape (machining shape) of the bore after the postforming is designed such that when the cylinder head is fastened to the cylinder block obtained after the postforming, the bore not having a true circular shape is deformed so as to become similar to an approximately-true circle.

Patent Document 1 is Japanese Unexamined Patent Application Publication No. 2000-291487.

DISCLOSURE OF THE INVENTION

Problems Solved by the Invention

However, in the technique of Patent Document 1, the cross section of the machined shape does not have a true circular shape. In this case, actually, in order that the bore having the above shape will be deformed so as to become similar to an approximately-true circle after the fastening of the cylinder head to the cylinder block, it is conceived that the side cross section of the machining machined shape of the bore is required to have a complicated shape having recesses and projections. Due to this, it is not easy to perform boring using a cutting tool, and it is also difficult to form a crosshatch on the inner surface of the bore by honing As a result, existing apparatuses cannot be used.

An object of the present invention is to provide a cylinder block and a machining method therefor which can improve cylindricity of a bore after fastening of a cylinder head by using existing apparatuses.

Means for Solving the Problems

According to one aspect of the present invention, a first cylinder block includes: a bore which is formed at a surface on which a cylinder head is to be fastened, wherein the bore has a cross section having an approximately-true circle shape before the cylinder head is fastened, and the approximately-true circle shape has a diameter changing along a central axial direction.

The first cylinder block according to the above aspect of the present invention is produced by a first machining method for a cylinder block according to another aspect of the present invention. That is, according to another aspect of the present invention, a first machining method for a cylinder block, includes steps of: obtaining deformation amount of a data-acquisition bore, which is deformed after fastening of a cylinder head to a cylinder block, along a central axial direction; determining an approximate shape, which approximates a deformation shape of the data-acquisition bore, by setting a cross section of the approximate shape to be an approximately-true circle shape and changing a diameter of the approximately-true circle shape along the central axial direction in accordance with the deformation amount of the data-acquisition bore; and determining a shape, which is obtained by reversing a phase of a recess and a projection of the approximate shape about a predetermined cylindrical shape, as a machining shape of a bore.

In the first machining method for a cylinder block according to the above aspect of the present invention, the machining shape (machined shape) of the bore is obtained based on the deformation amount of the data-acquisition bore after fastening of cylinder head. The cross section of the approximate shape, which approximates the deformation shape of the data-acquisition bore, is set to be the approximately-true circle shape, and the diameter of the approximately-true circle shape is changed along the central axial direction in accordance with the deformation amount of the data-acquisition bore, so that the approximate shape is determined. Thus, the approximate shape has a cross section having the approximately-true circle shape and has a simple shape which is symmetrical about the central axis. The number of measurement points of the deformation amount of the data-acquisition bore for obtaining the approximate shape can be smaller.

Since the machining shape of the bore is the shape obtained by reversing the phase of the recess and the projection of the approximate shape, which has the above simple shape, about the predetermined cylindrical shape, the machining shape (machined shape) has the cross section having the approximately-true circle shape and has a simple shape which is symmetrical about the central axis. Therefore, the machined shape of the bore can be easily obtained by boring and honing, and formation of crosshatch by honing can be easy. As a result, existing apparatuses can be used.

The first machining method for a cylinder block according to the above aspect of the present invention can use various structures. For example, according to a desirable embodiment of the present invention, a side cross section of the bore may be set to have an approximately-circular truncated cone shape, and a diameter of the approximately-circular truncated cone shape may be set to be larger from one surface to another surface. In this embodiment, since the machining shape (machined shape) of the bore is set to have a simple shape which is the approximately-circular truncated cone shape, so that the formation of the crosshatch by honing can be easier.

A second machining method for a cylinder block according to another aspect of the present invention is a specific method for obtaining of the first cylinder block according to the above aspect of the present invention by using an existing honing machine That is, according to another aspect of the present invention, a second machining method for a cylinder block, includes a step of: honing an inner surface of a bore by moving a head on the inner surface in an axial direction of the bore while rotating the head around a central axis of the bore, wherein in the moving of the head in the axial direction, rotational frequency of the head is adjusted in accordance with a position of the axial direction of the head in the bore.

In the second machining method for a cylinder block according to the above aspect of the present invention, in the moving of the head in the axial direction, the rotational frequency of the head is adjusted in accordance with the position of the axial direction of the head in the bore. The higher the rotational frequency of rotation of the head, the greater the grinding amount. The lower the rotational frequency of rotation of the head, the less the grinding amount. The rotational frequency of the head is controlled based on this relationship between the rotational frequency and the grinding amount, so that the grinding amount can be adjusted. Therefore, the rotational frequency of the head is changed in accordance with the position of the axial direction of the head, so that the bore can have a desired machined shape. In this case, since the head is rotated around the central axis, the machined shape of the bore has the cross section having the approximately-true circle shape, and the diameter of the approximately-true circle shape can be changed along the central axis. When the cylinder head is fastened to the cylinder block having the bore having the above machined shape, the bore may be deformed. However, the above machined shape of the bore is a shape obtained in consideration of the deformation of the bore deformed after the fastening, so that the cylindricity of the bore after the fastening of the cylinder head can be improved. These effects can be obtained by existing honing machines.

The second machining method for a cylinder block can use various structures. For example, according to a desirable embodiment of the present invention, the bore may be machined so as to have an approximately-circular truncated cone shape by setting rotational frequency of the head positioned at one end portion of the inner surface of the bore to be lower than rotational frequency of the head positioned at another end portion of the inner surface of the bore. The one end portion may be proximate to a side at which a cylinder head is to be fastened, and the another end portion may be opposite to the one end portion. In this embodiment, since lines of crosshatch may be approximately parallel to the axial direction at the upper end portion of the bore, lubricating oil may flow toward the lower end portion of the bore. Therefore, burning of the lubricating oil can be inhibited in operation.

A second cylinder block according to the another aspect of the present invention is produced by the second machining method for a cylinder block according to the above aspect of the present invention. The second cylinder block according to the above aspect of the present invention can obtain the same effects as those of the second machining method for a cylinder block according to the above aspect of the present invention.

Effects of the Invention

According to the first cylinder block or the machining method for the same of the present invention, the machining shape (machined shape), which is designed in consideration of the deformation of the bore deformed after the fastening, has a cross section having the approximately-true circle shape and has a simple shape which is symmetrical about the central axis. As a result, the cylindricity of the bore after the fastening of the cylinder head can be improved by using existing apparatuses.

According to the second cylinder block or the machining method for the same of the present invention, the machined shape designed in consideration of the deformation of the bore deformed after the fastening can be obtained. As a result, the cylindricity of the bore after the fastening of the cylinder head can be improved. These effects can be obtained by using existing apparatuses.

BRIEF DESCRIPTION OF DRAWINGS

FIG. 3A is side cross sectional view which shows a machined shape of a bore before fastening of the cylinder head, and FIG. 3B is side cross sectional view which shows a deformed shape of a bore after fastening of the cylinder head.

FIG. 4A is a side cross sectional view which shows a machined shape of a bore before fastening of the cylinder head, and FIG. 4B is a side cross sectional view which shows a deformed shape of a bore after fastening of the cylinder head.

FIG. 7 is a side cross sectional view which shows a portion of condition of honing.

FIG. 9A is a side cross sectional view which shows a portion of conditions of honing in a case in which a head is positioned at an initial position, FIG. 9B is a side cross sectional view which show a portion of conditions of honing in a case in which a head is positioned at a top dead point, and FIG. 9C is a side cross sectional view which shows a portion of conditions of honing in a case in which a head is positioned at a bottom dead point.

EXPLANATION OF REFERENCE NUMERALS

Figure 1:
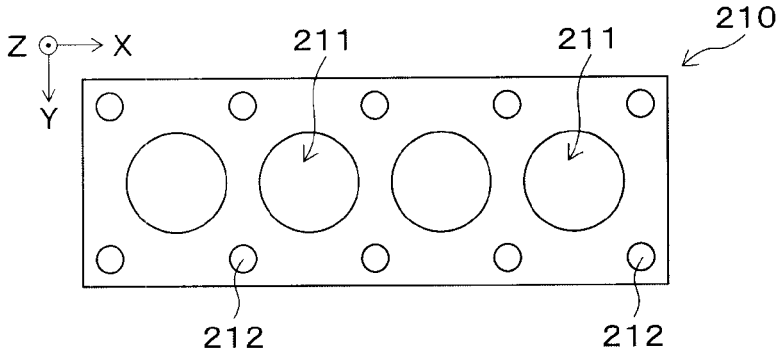
FIG. 1 is a plane view which shows a schematic structure of a specific example of a cylinder block used in a four-cylinder engine.

Reference numeral 110 denotes a cylinder block, reference numeral 111 denotes a bore, reference numeral 111A denotes an inner surface, reference numeral 220 denotes a cylinder head, and reference numeral 302 denotes a head.

BEST MODE FOR CARRYING OUT THE INVENTION (1) Machined Shape of Bore

Figure 4A:
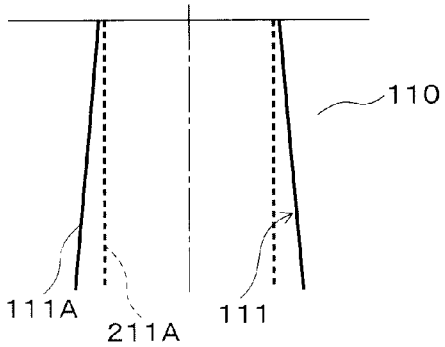
FIGS. 4A and 4B are diagrams for explaining a deformed shape of a bore in fastening of a cylinder head to a cylinder block according to the present invention.
Figure 4B:
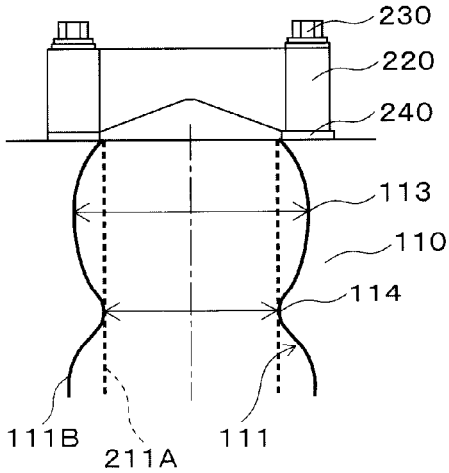

One embodiment of the present invention will be explained hereinafter with reference to Figures. FIGS. 4A and 4B are diagrams for explaining a structure of a cylinder block 110 of one embodiment according to the present invention. FIG. 4A is a diagram which shows a machined shape of a bore 111, and FIG. 4B is a diagram which shows a deformed shape of the bore 111, which is shown in FIG. 4A, after fastening of a cylinder head 220. The X direction in FIG. 4A is a horizontal direction on an upper side opening surface of the bore 111. The Y direction in FIG. 4A is a direction perpendicular to the X direction on the upper side opening surface of the bore 111. The Z direction in FIG. 4A is a direction perpendicular to the upper side opening surface of the bore 111. The dashed line in FIGS. 4A and 4B is a central axis.

Figure 2:
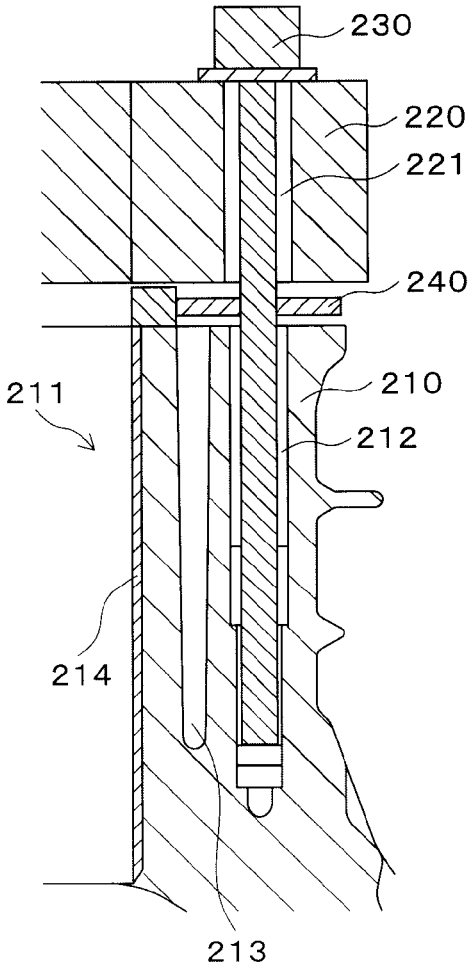
FIG. 2 is a side cross sectional view which shows a condition in which a cylinder head is fastened to a cylinder block.

A cylinder block of this embodiment is different in the machined shape (machining shape) of the bore from the cylinder block 210 shown in FIGS. 1 and 2, and structures other than this difference are the same as those of the cylinder block 210. Thus, in this embodiment, the same components as those shown in FIGS. 1 and 2 use the same reference numerals, and explanation thereof is omitted.

Figure 3A:
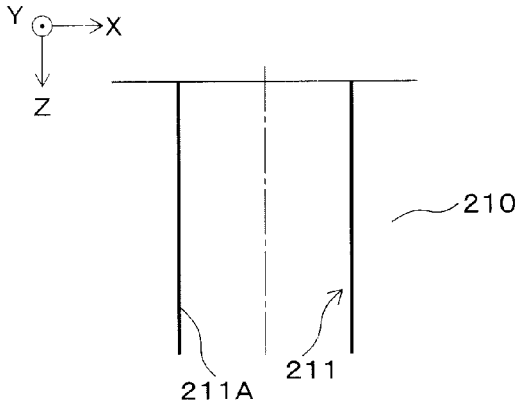
FIGS. 3A and 3B are diagrams for explaining a deformed shape of a bore in fastening of a cylinder head to a cylinder block.

As shown in FIG. 4A, a machined shape of the bore 111 of the cylinder block 110 is an approximately-circular truncated cone shape which has a side cross section having a tapered shape and which has a cross section having an approximately-true circle shape. The tapered shape of the bore 111 is inclined in a straight line manner so as to have a diameter larger from an upper surface side of the bore 111 to a lower surface side of the bore 111. In this case, the upper surface side of the bore 111 has a diameter equal to that of the bore 211 having the machined shape which is a cylindrical shape shown in FIG. 3A.

When the cylinder head 220 is fastened to an upper surface of the cylinder block 110, as shown in FIG. 4B, in the bore 111, an inner diameter of an upper end portion 113 is larger, and an inner diameter of an intermediate portion 114 is smaller. However, since the side cross section of the machined shape of the bore 111 has the above tapered shape, the diameter of deformation shape of the intermediate portion 114 of the bore 111 is larger than that of the case of the bore 211 having the cylindrical shape shown in FIG. 3A. Thus, when a piston slides on an inner surface of the bore 111 after fastening of the cylinder head 220, the friction at the intermediate portion 114 is reduced.

(2) Method of Determining Machined Shape of Bore

Figure 5:
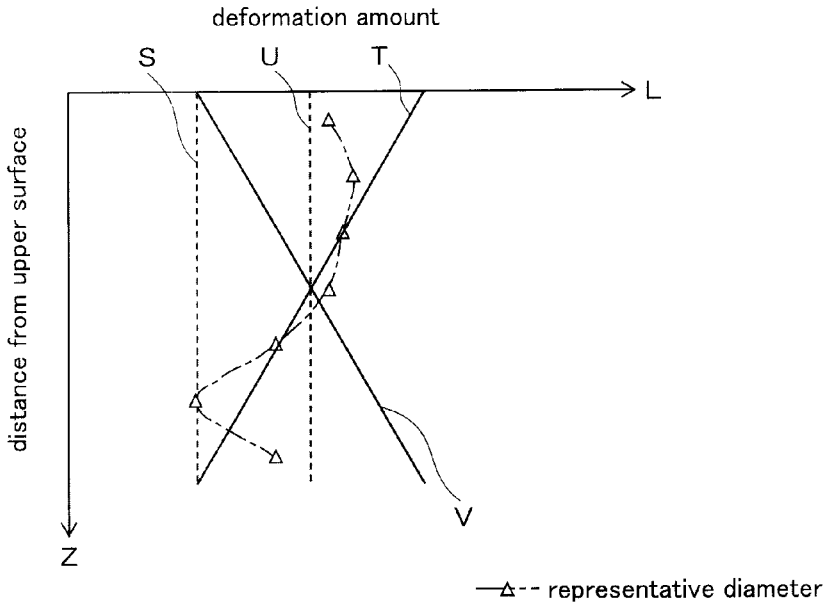
FIG. 5 is a data diagram which shows a deformed shape of a data acquisition bore in a condition in which a cylinder head is fastened and which is used for determination of a machining shape of a bore.
Figure 6:
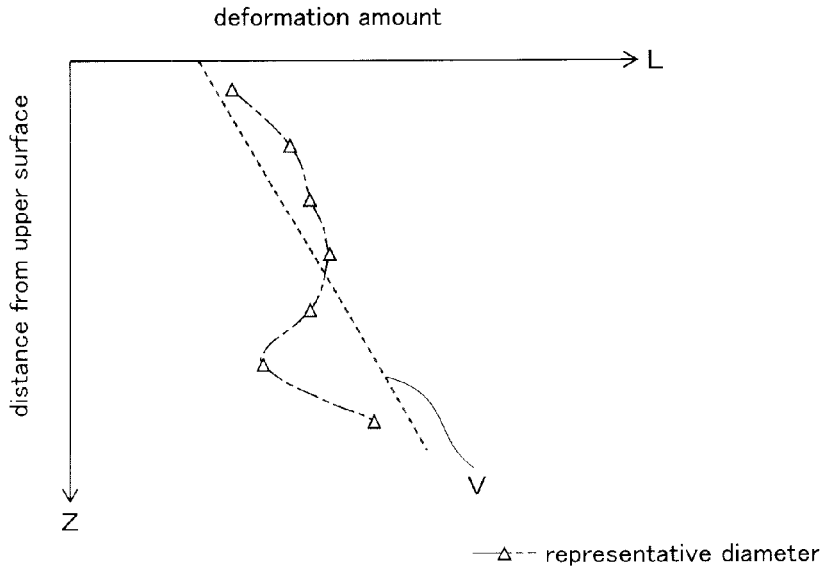
FIG. 6 is a data diagram which shows a deformed shape of the bore having a machined shape (machining shape), which is determined by the data diagram of FIG. 5, after fastening of the cylinder head.

A method of determining the machined shape of the bore 111 will be explained by mainly referring to FIGS. 5 and 6. FIG. 5 is a data diagram which shows a deformed shape of a data acquisition bore in a condition in which a cylinder head is fastened and which is used for determination of a machining shape of a bore. FIG. 6 is a data diagram which shows a deformed shape of the bore having the machined shape (machining shape), which is determined by the data diagram of FIG. 5, after fastening of the cylinder head. The X direction and the Y direction in FIGS. 5 and 6 are the X direction and the Y direction in FIGS. 3A and 4A. The L-axis is an axis which shows deformation amounts in FIGS. 5 and 6. The origin of the Z direction in FIGS. 5 and 6 is positioned at the upper side opening surface of the bore 111. The Z-axis in FIGS. 5 and 6 is an axis which shows distance from the upper side opening surface of the bore 111 in FIGS. 5 and 6. The straight line S in FIG. 5 denotes a generatrix of the inner surface 211A of the machining shape of the data-acquisition bore.

First, a data-acquisition bore is machined at an upper surface of a data-acquisition cylinder block. The machined shape of the data-acquisition bore has a cylindrical shape shown by the dashed line in FIG. 4A, and the side cross section of the inner surface thereof has a straight line shape. The data-acquisition bore is the same as the bore 211 shown in FIG. 3A, and regarding the data-acquisition bore, the same reference numerals as those of the bore 211 are used hereinafter. The cylinder head 220 is fastened to the upper surface of the cylinder block, and the deformation shape of the data-acquisition bore 211 after fastening of the cylinder head 220 is obtained. Specifically, change amounts of the X direction diameter and the Y direction diameter of the deformation shape of the data-acquisition bore 211 are measured at predetermined intervals from the upper side opening surface to the lower side. Next, the average value of the change amounts of the X direction diameter and the Y direction diameter of the deformation shape is calculated as a representative diameter. The calculation method of the representative diameter is not limited to the above method, and if necessary, another appropriate method can be used.

Next, an approximate straight line T of the representative diameter is calculated. The approximate straight line T is an approximate equation defining an approximate shape of the deformation shape. The approximate equation can be calculated by the method of least squares. Next, a straight line U is calculated. The straight line U passes through an intermediate point between the origin and the intersection point of the approximate straight line T and the straight line of Z=0, and the straight line U is parallel to the Z-axis. Next, a straight line V is calculated. The straight line V is symmetrical to the approximate straight line T of the deformation shape about the straight line U. The straight line V is an equation defining a machining shape of a bore. The machining shape of the bore (approximately-circular truncated cone shape formed by rotating the straight line V around the central axis of bore) is obtained by reversing a phase of a recess and a projection of the approximate shape of the data-acquisition bore about a cylindrical shape (predetermined cylindrical shape) which has the straight line U as the generatrix. The straight line U, which is used in reversing a phase of a recess and a projection of the approximate shape of the data-acquisition bore, is not limited to the one shown in FIG. 5, and if necessary, the straight line U can be appropriately set.

Figure 3B:
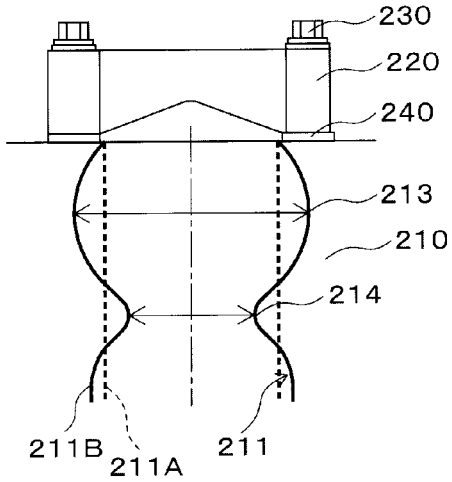

As described above, the machining shape (machined shape) of the bore 111 is an approximately-circular truncated cone shape which has a side cross section having a tapered shape inclined in a straight line manner so as to have a diameter larger from the upper surface side of the bore 111 to the lower surface side of the bore 111. Next, when the cylinder head 220 is fastened to the upper surface of the cylinder block 110 which has the bore 111 having the above the machined shape, as shown in FIG. 4B, the inner surface 111A of the bore 111 is deformed so as to be an inner surface 111B. In this case, however, as shown in FIG. 6, deformation amounts of the upper end portion 113 and the intermediate portion 114 of the inner surface 111 B of the bore 111 are smaller than those of the upper end portion 213 and the intermediate portion 214 of the bore 211 having the cylindrical shape as the machined shape as shown in FIG. 3B. For example, the maximum width of the deformation amount of the inner surface 211B of the data-acquisition bore 211 was 25 μm (micrometers), but the maximum width of the deformation amount of the inner surface 111 B of the bore 111 was 16 μm. Thus, it was confirmed that the bore 111 having the tapered shape as the machined shape is more improved in cylindricity than the bore 211 having the straight line shape as the machined shape.

(3) Machining Method for Cylinder Block

Figure 7:
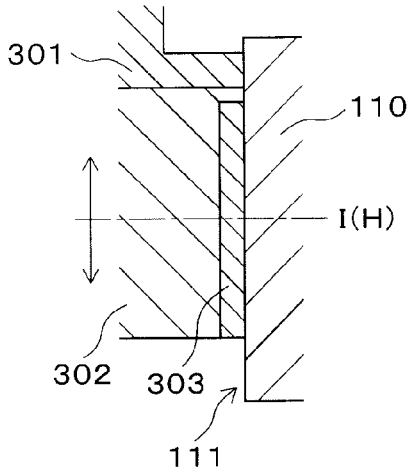
FIG. 7 is a diagram for explaining a honing method in a machining method for cylinder block according to the present invention.

A machining method for cylinder blocks will be explained. For example, an inner surface of a bore 111 of a cylinder block 110 is subjected to rough machining by boring. In this case, the bore 111 is machined so as to have a cylindrical shape. Next, the inner surface of the bore 111 is subjected to finish machining by honing For example, a honing machine used for honing has a columnar head and a grinding stone provided at a surface of the head. The grinding stone has a rectangular parallelepiped shape extending in an axial direction of the head. In honing, as shown in FIG. 7, on an inner surface of a bore 111, a head 302, which is supported by a holder 301, is reciprocated in an axial direction while being rotated around the axial direction, so that the inner surface of the bore 111 is ground by a grinding stone 303. In this embodiment, a machined shape of the bore 111 can be obtained by honing using the following method.

(A) Method for Control of Rotational Speed of Head

Figure 8:
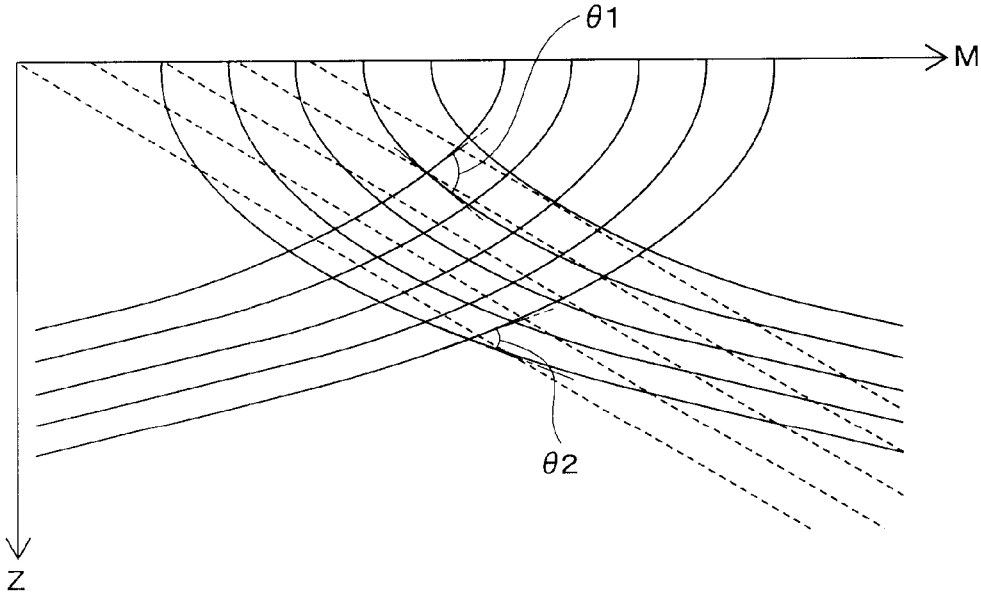
FIG. 8 is a diagram for explaining change in shape of crosshatch when rotational frequency of head is changed in honing

In this method, for example, as shown in FIG. 7, on the inner surface of the bore 111, the reciprocating center I of the head 302 is positioned at the center H of the axial direction of the bore 111, and the head 302 is moved from an upper end portion to a lower end portion on the inner surface of the bore 111. The higher the rotational frequency of rotation of the head 302, the greater the grinding amount. The lower the rotational frequency of rotation of the head 302, the less the grinding amount. When the rotational frequency of rotation of the head 302 is set to be higher from the upper end portion to the lower end portion based on this relationship between the rotational frequency and the grinding amount, the grinding amount by the grinding stone 303 of the head 302 is greater from the upper end portion to the lower end portion. Thus, the bore 111 is machined so as to have an approximately-circular truncated cone shape having a tapered side cross section In finish machining by honing, a crosshatch is formed on the inner surface of the bore 111. FIG. 8 is a diagram for explaining change in shape of the crosshatch when the rotational frequency of the head 302 is changed in honing FIG. 8 is a portion of a development diagram showing the inner surface of the bore 111. In FIG. 8, the solid line denotes a portion of a specific example of crosshatch shape formed when the rotational frequency of rotation of the head 302 is set to be higher from the upper end portion to the lower end portion, and the dashed line denotes a portion of a specific example of crosshatch shape formed when the rotational frequency of rotation of the head 302 is set to be constant. The M-axis denotes an axis of peripheral direction.

In this case, when the rotational frequency of rotation of the head 302 is set to be lower, lines of the crosshatch are approximately parallel to the axial direction. However, when the rotational frequency of rotation of the head 302 is set to be higher, lines of the crosshatch are approximately perpendicular to the axial direction. In this embodiment, since the rotational frequency of rotation of the head 302 is set to be higher from the upper end portion to the lower end portion, as shown in FIG. 8, the angle of each line of the crosshatch with respect to the axial direction is greater from the upper end portion to the lower end portion. In this case, the crossing angle of the lines of the crosshatch is less from the upper end portion to the lower end portion. For example, the crossing angle θ2 at the lower end portion is less than the crossing angle θ1 at the upper end portion. Since the crosshatch is approximately parallel to the axial direction at the upper end portion of the bore 111, lubricating oil flows toward the lower end portion. Therefore, burning of lubricating oil can be inhibited in operation. In this case, there may be no lubricating oil at the upper end portion. However, the upper end portion is not a portion on which a piston slides, so no problem occurs.

(B) Method for Adjustment of Center Position of Reciprocating of Head

Figure 9A:
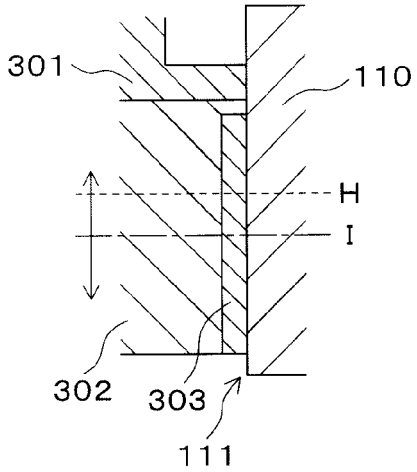
FIGS. 9A to 9C are diagrams for explaining another honing method in a machining method for a cylinder block according to the present invention.
Figure 9B:
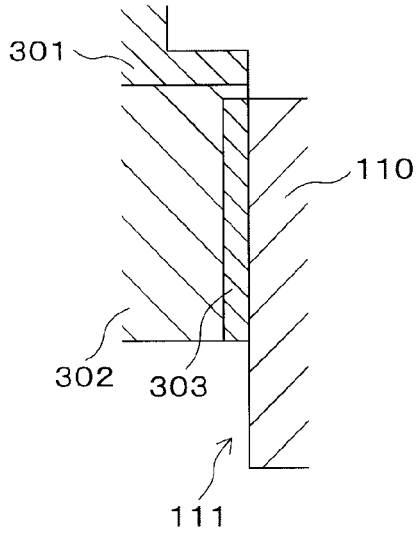
Figure 9C:
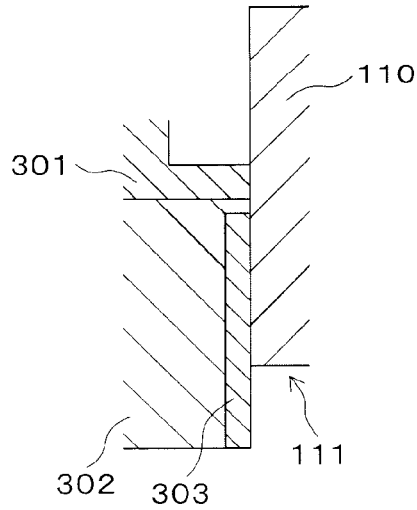

In this method, for example, the rotational frequency of rotation of the head 302 in reciprocating is set to be constant, and as shown in FIG. 9A, on the inner surface of the bore 111, the reciprocating center I of the head 302 is positioned lower than the center H of the axial direction of the bore 111. In this case, in the reciprocating, at the top dead point, for example, as shown in FIG. 9B, the upper end portion of the grinding stone 303 is positioned at the upper end of the inner surface of the bore 111, and at the bottom dead point, as shown in FIG. 9C, the lower end portion of the grinding stone 303 is positioned lower than the lower end of the inner surface of the bore 111.

In this reciprocating of the head 302, the lower end portion of the grinding stone 303 projects more downwardly than the lower end of the inner surface of the bore 111, and the contact area between the grinding stone 303 and the inner surface of the bore 111 is smaller from the upper end portion to the lower end portion. Thus, the surface pressure to the inner surface of the bore 111 by the grinding stone 303 is higher from the upper end portion to the lower end portion, and the grinding amount by the grinding stone 303 is greater from the upper end portion to the lower end portion. As a result, the bore 111 is machined so as to have an approximately-circular truncated cone shape having a tapered side cross section.

Figure 10A:
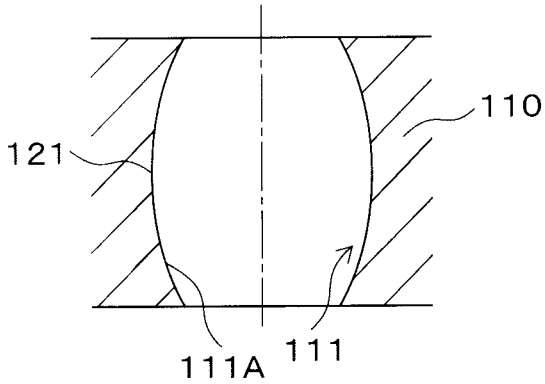
FIGS. 10A and 10B are side cross sectional views which show modification examples of machined shapes (machining shapes) of bores.
Figure 10B:
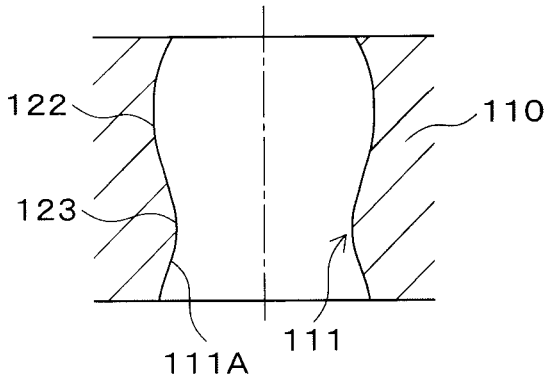

The machined shape (machining shape) of the bore of this embodiment is not limited to the approximately-circular truncated cone shape. The machined shape of the bore may have a cross section having an approximately-true circle shape, and the approximately-true circle shape may have a diameter changing along a central axial direction. For example, in the machined shape of the bore, the side cross section thereof has a shape curved in the axial direction. In this case, for example, as shown in FIG. 10A, the side cross section may have a diameter expansion portion 121 at a center portion thereof, and for example, as shown in FIG. 10B, the side cross section may have a diameter expansion portion 122 and a diameter reduction portion 123. In order to obtain the machined shape of the bore 111 shown in FIG. 10B, when the honing using the method shown in FIGS. 9A to 9C is used, if necessary, a head 302, which has an axial direction length corresponding to an interval between the diameter expansion portion 122 and the diameter reduction portion 123, may be used. In this embodiment, rotational speed of the head 302 may be appropriately controlled in accordance with the position of the axial direction position of the head 302 on the inner surface of the bore 111, the position of the reciprocating center I of the head 302 with respect to the center H of the axial direction of the inner surface of the bore 111 may be appropriately set, or these methods may be appropriately combined. Thus, various shapes of the bore can be obtained.

As described above, in this embodiment, the cross section of the approximate shape, which approximates the deformation shape of the data-acquisition bore 211, is set to be the approximately-true circle shape, and the diameter of the approximately-true circle shape is changed along the central axial direction in accordance with the deformation amount of the data-acquisition bore 211, so that the approximate shape (the shape defined by the straight line T) is determined. Thus, the approximate shape has a cross section having the approximately-true circle shape and has a simple shape which is symmetrical about the central axis. The number of measurement points of the deformation amount of the data-acquisition bore 211 for obtaining the approximate shape can be smaller.

Since the machining shape of the bore 111 is the shape (the shape defined by the straight line V) obtained by reversing the phase of the recess and the projection of the approximate shape, which has the above simple shape, about the predetermined cylindrical shape, the machining shape (machined shape) has the cross section having the approximately-true circle shape and has a simple shape which is symmetrical about the central axis. Therefore, the machined shape of the bore 111 can be easily obtained by boring and honing, and formation of the crosshatch by honing can be easy. As a result, existing apparatuses can be used.

When the method for control of rotational speed of the head 302 is used, in the moving of the head 302 in the axial direction, the rotational frequency of the head 302 is controlled based on this relationship between the rotational frequency and the grinding amount, so that the grinding amount can be adjusted. Therefore, the rotational frequency of the head 302 is changed in accordance with the position of the axial direction of the head 302, so that the bore 111 can have a desired machined shape. In this case, since the head 302 is rotated around the axis, the machined shape of the bore 111 has the cross section having the approximately-true circle shape, and the diameter of the approximately-true circle shape can be changed along the central axis. When the cylinder head 220 is fastened to the cylinder block 110 having the bore 111 having the above machined shape, the bore 111 may be deformed. However, the above machined shape of the bore 111 is a shape obtained in consideration of the deformation of the bore 111 deformed after the fastening, so that the cylindricity of the bore 111 after the fastening of the cylinder head 220 can be improved. These effects can be obtained by existing honing machines.

In particular, the machining shape (machined shape) of the bore 111 is set to have a simple shape which is the approximately-circular truncated cone shape, so that the formation of the crosshatch by honing can be easier. In this case, since the lines of the crosshatch is approximately parallel to the axial direction at the upper end portion of the bore 111, lubricating oil flows toward the lower end portion of the bore 111. Therefore, burning of the lubricating oil can be inhibited in operation.

The invention claimed is:

1. A machining method for a cylinder block, comprising steps of:

obtaining deformation amount of a data-acquisition bore, which is deformed after fastening of a cylinder head to a cylinder block, along a central axial direction;

determining an approximate shape, which approximates a deformation shape of the data-acquisition bore, by setting a cross section of the approximate shape to be an approximately-true circle shape and changing a diameter of the approximately-true circle shape along the central axial direction in accordance with the deformation amount of the data-acquisition bore; and determining a shape, which is obtained by reversing a phase of a recess and a projection of the approximate shape about a predetermined cylindrical shape, as a machining shape of a bore, wherein a side cross section of the bore is set to have an approximately-circular truncated cone shape, and a diameter of the approximately-circular truncated cone shape is set to be larger from one surface to another surface.

2. A cylinder block obtained by the machining method for a cylinder block according to claim 1.

* * * * *